United States Patent [19]

Gruhn et al.

[11] 3,977,748

[45] Aug. 31, 1976

[54] ZERO INSERTION FORCE CONNECTOR ASSEMBLY

[75] Inventors: William D. Gruhn, Lombard; Cletus G. McDonough, Elmhurst, both of Ill.

[73] Assignee: Molex Incorporated, Lisle, Ill.

[22] Filed: Apr. 23, 1974

[21] Appl. No.: 463,267

[52] U.S. Cl. ..... 339/75 M; 339/258 T; 339/66 M

[51] Int. Cl.[2] ..... H01R 13/54

[58] Field of Search ..... 339/65, 66, 75 R, 75 M, 339/75 MP, 75 P, 75 T, 258 T

[56] References Cited

UNITED STATES PATENTS

| | | | |
|---|---|---|---|
| 3,145,067 | 8/1964 | Mishelevich | 339/75 M |
| 3,315,212 | 4/1967 | Peterson | 339/75 M |
| 3,430,183 | 2/1969 | Feeser | 339/75 R |
| 3,693,139 | 9/1972 | Assmus | 339/258 T |
| 3,763,459 | 10/1973 | Millis | 339/75 M |
| 3,793,612 | 2/1974 | Driscoll | 339/98 |

*Primary Examiner*—Roy Lake
*Assistant Examiner*—Mark S. Bicks
*Attorney, Agent, or Firm*—Louis A. Hecht

[57] ABSTRACT

A zero insertion force connector assembly includes a pair of connector housings each including an array of terminals. As the housings are initially moved together, the terminals are not in engagement and zero insertion force is provided. The housings are subsequently moved transversely with respect to one another in order to close individual pairs of terminals. Each terminal includes a contact blade parallel to the contact blade of another terminal, and the blades are disposed at a forty-five degree angle relative to the direction of transverse housing movement. One blade of each contact pair is supported along one of its edges to provide for a twisting action and reliable electrical contact as the blades are engaged. Transverse movement of the housings is effected by an actuator member mounted on one housing by an integral hinge and movable to a latched position wherein it forces the other housing member to a transverse position thereby closing each of the individual pairs of contacts.

13 Claims, 19 Drawing Figures

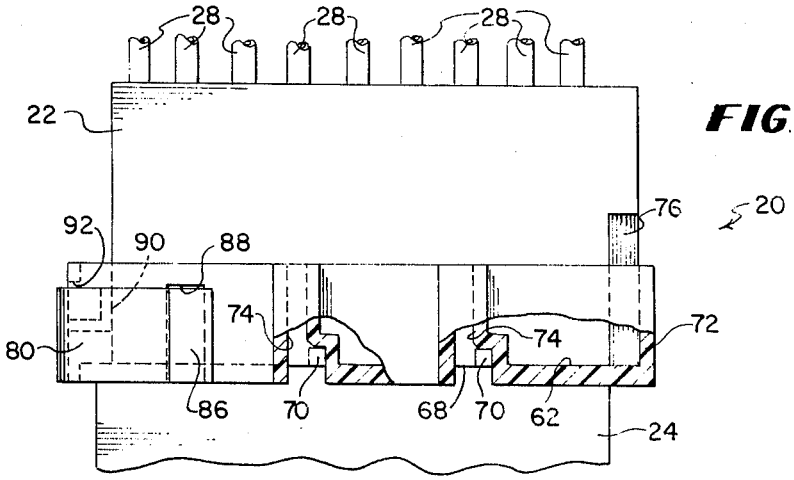
FIG. 4
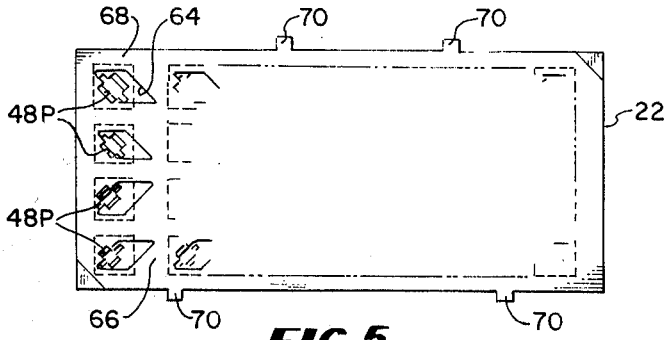
FIG. 5
FIG. 7
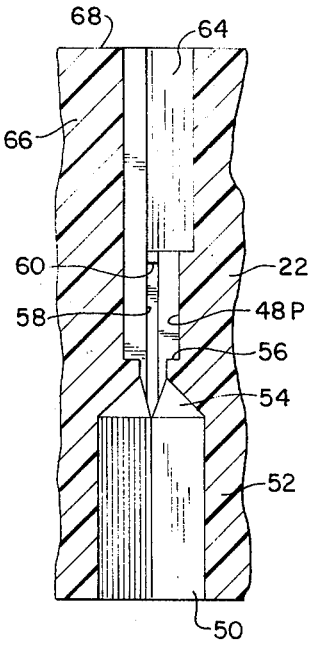
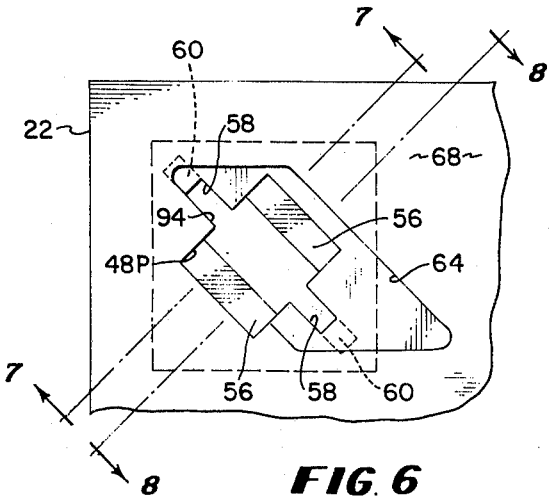
FIG. 6
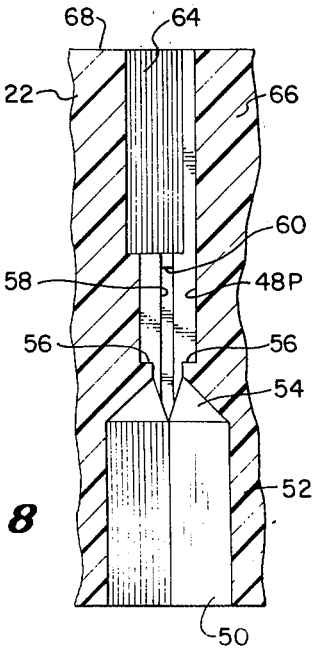
FIG. 8

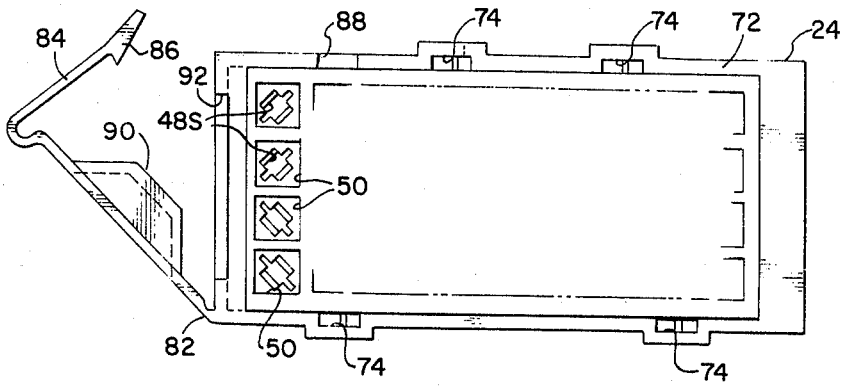
FIG. 9
FIG. 10
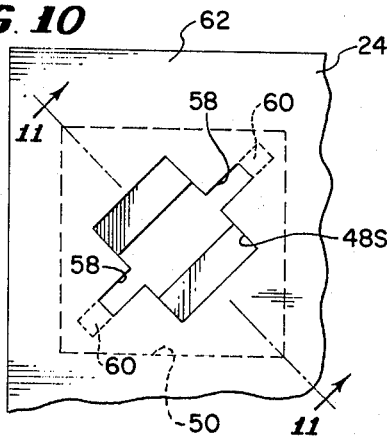
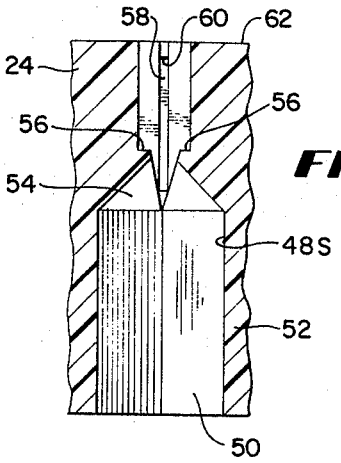
FIG. 11
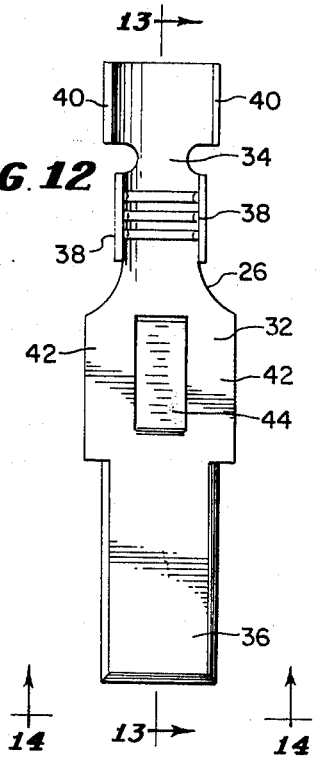
FIG. 12
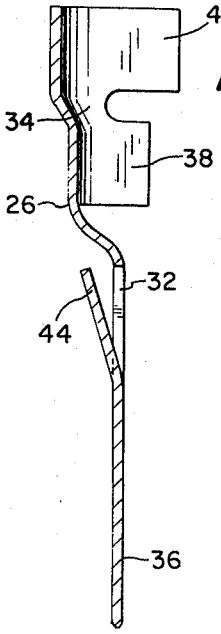
FIG. 13
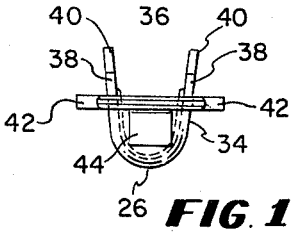
FIG. 14

FIG. 15
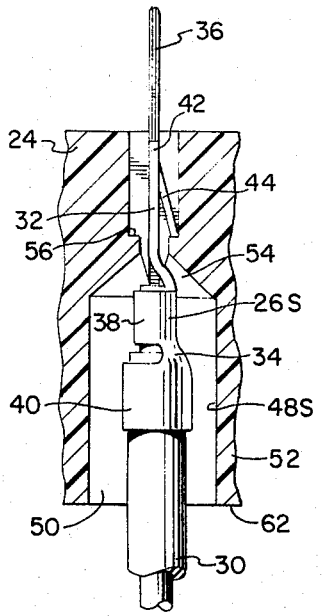
FIG. 16
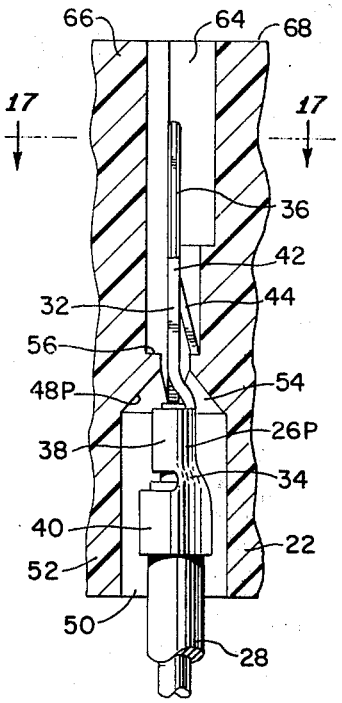
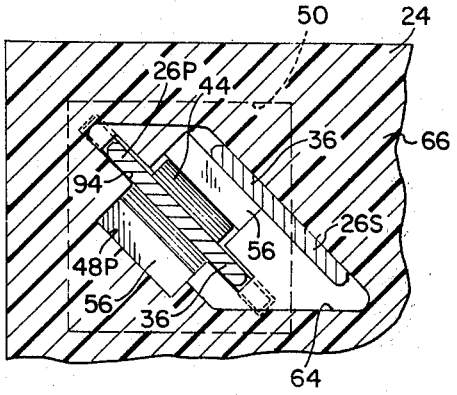
FIG. 17
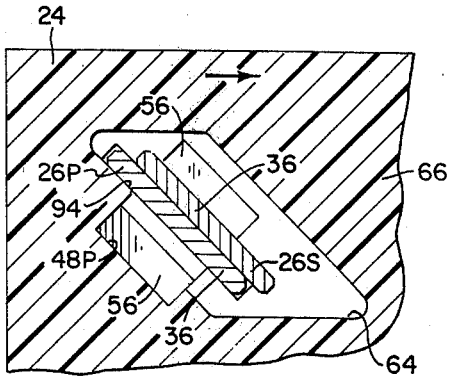
FIG. 18
FIG. 19
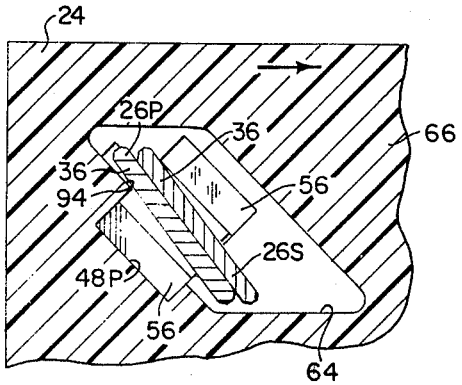

ZERO INSERTION FORCE CONNECTOR ASSEMBLY

The present invention relates to electrical connectors, and more particularly to connector assemblies known as zero insertion force assemblies.

In the use of conventional electrical terminals, such as widely used pin and socket terminals, a frictional force, known as an insertion force, is encountered when the terminals are interconnected. The forces involved are not objectionable when only one or a few pairs of such terminals are interconnected. When a large number of interconnections are made in a single operation, for example in the connecting of wiring harnesses and the like, the total insertion force becomes undesirably large.

In order to overcome the problem of excessive insertion forces, so-called zero insertion force connectors have been developed. In the usual arrangement of such connectors, two connector housings are moved in a first direction toward one another. At this time, the pairs of terminals of the two housings are not in contact with one another so that little or no frictional forces resulting from such engagement need be overcome. Such connectors typically include a mechanism such as a cam or wedge device or the like for forcing the individual pairs of terminals into engagement after connection of the housings. Known zero insertion force connector assemblies have not been entirely satisfactory because they are typically quite complex and therefore expensive to manufacture and difficult to use. In addition, known devices include several different parts which must be assembled and operated with care, and are often bulky and cumbersome in shape.

An object of the present invention is to provide a zero insertion force connector assembly which is extremely simple in design and consequently easily manufactured and used. Another object is to provide an assembly having a novel contact configuration making possible reliable electrical interconnections in an improved manner. A further object is to provide a novel structure for actuating the housings of the assembly transversely of one another in order to effect closure of the contact pairs. More general objects of the invention are to provide improvements in zero insertion force connector assemblies and to overcome the disadvantages encountered with devices of this character which have been developed in the past.

In brief, in accordance with the above and other objects of the invention, there is provided a zero insertion force connector assembly including a pair of connector housings adapted to be joined together. Guide means are provided on the housings for guiding the housings in a first direction relative to one another as they are moved together to an intermediate position. After reaching the intermediate position, the guide means guide the housings transversely of one another in a second direction to a final position. A number of pairs of terminals are supported on the housings, each pair including one terminal supported by one housing and another terminal supported by the other housing. The terminals of each pair are spaced apart as the housings are moved to the intermediate position. When the housings are moved from the intermediate position to the final position, the terminals of each pair are moved into engagement with one another.

In accordance with a feature of the invention, each terminal includes a blade cantilever-supported on one housing and extending toward the other housing. The blade contacts of the terminals of each pair are parallel with one another and are disposed at an angle relative to the direction of transverse housing movement. The back of one edge of one terminal blade is supported so that as the blades are moved into contact, the contacting blades are permitted to twist or pivot around the support thus providing for overtravel and for a reliable electrical contact between the blades.

In accordance with another feature of the invention, an actuator member is supported by an integral hinge on one of the connector housings. After the housings are moved to the intermediate position, the actuator member is pivoted to a closed position and is releasably latched in place. During this pivoting motion the actuator member engages the other connector housing and produces the desired transverse movement. The guide means preferably includes a bayonet lock configuration serving to prevent separation of the housings so long as the actuator member remains latched.

The invention together with the above and other objects and advantages may be best understood with reference to the following detailed description of the embodiment of the invention illustrated in the accompanying drawings wherein:

FIG. 4 is a fragmentary side view similar to part of FIG. 3 and illustrating the housings in their final position;

FIG. 5 is a front view of the plug connector housing of the assembly of FIG. 1;

FIG. 6 is an enlarged detail view of one portion of FIG. 5 showing one terminal receiving cavity and contact chamber;

FIG. 7 is a sectional view taken along the line 7—7 of FIG. 6;

FIG. 8 is a sectional view taken along the line 8—8 of FIG. 6;

FIG. 9 is a back view of the socket connector housing of the assembly of FIG. 1;

FIG. 10 is an enlarged detail view showing one terminal receiving cavity of the housing of FIG. 9, viewed from the front;

FIG. 11 is a sectional view taken along the line 11—11 of FIG. 10;

FIG. 12 is an elevational view of one terminal of the assembly of FIG. 1, illustrating the terminal before it is engaged with a conductor;

FIG. 13 is a sectional view taken along the line 13—13 of FIG. 12;

FIG. 14 is an end view of the terminal of FIG. 12;

FIG. 15 is a view similar to FIG. 11 illustrating a terminal mounted in a terminal receiving cavity of the socket connector housing;

FIG. 16 is a view similar to FIG. 7 illustrating a terminal mounted in a terminal receiving cavity of the plug connector housing;

FIG. 17 is a fragmentary sectional view taken along the line 17—17 of FIG. 16 and showing two contacts of a terminal pair when the housings are in the intermediate position;

FIG. 18 is a view similar to FIG. 17 showing the contacts when the housings are transversely moved partly to the final position; and FIG. 19 is a view similar to FIGS. 17 and 18 showing the contacts when the housings are in the final position.

Figure 1:
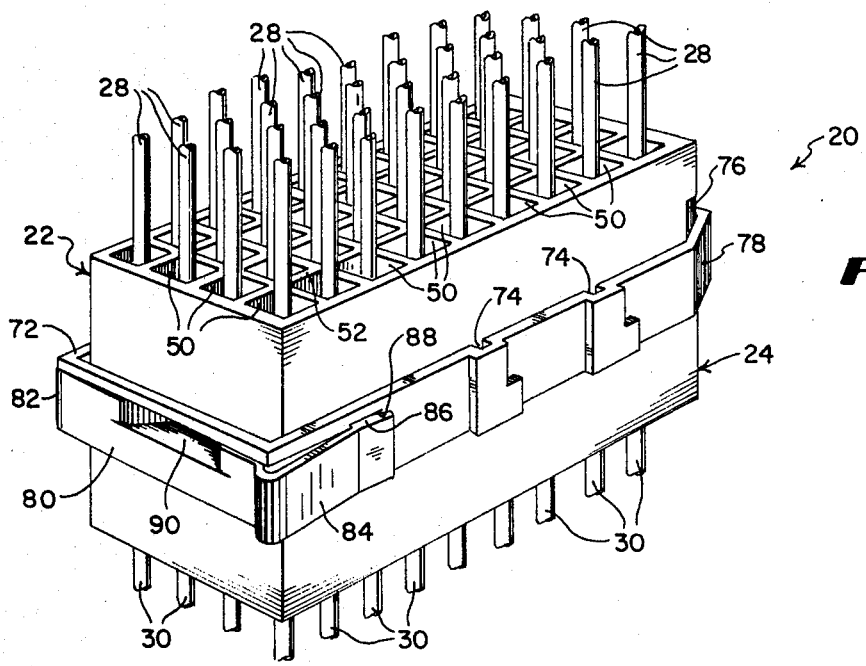
FIG. 1 is a perspective view of a zero insertion force connector assembly constructed in accordance with the present invention.
Figure 2:
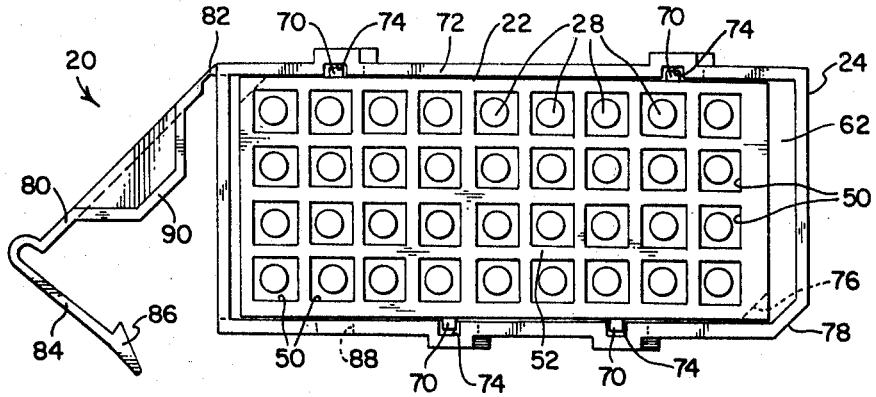
FIG. 2 is a top view of the assembly of FIG. 1 with the connector housings in an intermediate position.
Figure 3:
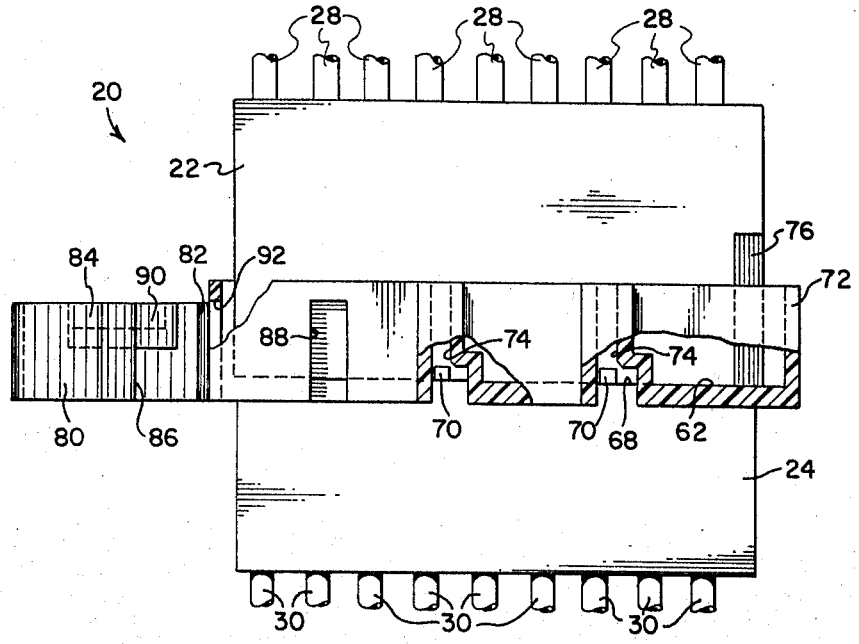
FIG. 3 is a side view, partly broken away, of the assembly of FIG. 1 with the housings in an intermediate position.

Having reference now to the drawings, and initially to FIGS. 1–4, there is illustrated a zero insertion force connector assembly constructed in accordance with the principles of the present invention and designated as a whole by the reference numeral 20. The assembly 20 includes a pair of connector housings 22 and 24, and in the illustrated embodiment of the invention the housings 22 and 24 comprise respectively a plug housing and a socket housing. It should be understood that other housing configurations such as for example hermaphroditic housings could be provided, and in addition one or both of the housings may be provided with conventional panel mounting structure.

Each of the housings 22 and 24 is provided with a plurality of terminals 26. Although each of the terminals used in the assembly 20 is identical with the others, to facilitate an understanding of the invention the designation 26P is used to designate a terminal when mounted in the plug housing 22, and the designation 26S is used to designate a terminal when mounted in the socket housing 24. The assembly 20 serves to provide a releasable electrical connection between one group of electrical conductors 28 connected to the terminals 26P of housing 22 and a second group of electrical conductors 30 connected to the terminals 26S of the housing 24.

Having reference now more specifically to FIGS. 12–14 each terminal 26 is formed, as for example by a sequence of press operations, from conductive sheet metal material such as brass or the like. Each terminal 26 includes an intermediate base portion 32 extending between a conductor engaging portion 34 and a flat blade contact portion 36. In the illustrated arrangement, the conductors 28 and 30 comprise insulation clad wire conductors. Consequently, the conductor engaging portion 34 of each terminal 26 includes wire crimp structure in the form of a pair of wire crimping flanges 38 adapted to be crimped against a conductor wire and a pair of insulation crimping flanges 40 adapted to be crimped against the insulation of a wire. It should be understood that the principles of the present invention may be applied to connectors used with conductors other than insulation clad wires, and the conductor engaging portions 34 may take other forms, such as, by way of example, solder tails, wire wrap posts, or other.

In order to assist in guiding and retaining each terminal 26 in position in the housing 22 or 24 after connection to a wire, the base portion 32 of the terminal is provided with a pair of wing members 42 on its opposite sides and with a locking tang 44 struck from an intermediate region of the base 32. Preferably the sides and end of the blade contact portion 36 are coined in order to provide for smooth insertion of the terminal 26 into its housing and to provide for smooth engagement of the blade contacts 36 with one another.

Proceeding now to a more detailed description of the plug and socket housings 22 and 24, the housings may be formed as by molding from a suitable plastic material having electrical insulating properties. In the illustrated arrangement the plug housing 22 and the socket housing 24 are each adapted to receive thirty-six terminals 26 arranged in four rows of nine each. It should be understood that more or fewer terminals could be provided in any type of array. The housings 22 and 24 are each provided with an array of cavities 48, one for receiving each terminal 26. Although the cavities of the plug 22 and socket 24 are similar, the reference number 48P is used to designate a cavity in the plug 22, while the reference numeral 48S is used to designate a cavity in the socket 24.

A cavity 48S of the socket housing 24 is shown in FIGS. 10 and 11, and a cavity 48P of the plug housing 22 is shown in FIGS. 6–8. Each cavity includes an enlarged entrance area 50 facing the rear of the respective housing through which a terminal 26 with a conductor attached is inserted. The individual entrance areas 50 of the various cavities 48 are separated in both housings 22 and 24 by a honeycomb wall structure 52 serving to prevent inadvertent short circuiting between the conductor engaging portions 34 of adjacent terminals 26.

In order to capture a terminal 26 within the cavity 48, the cavity is provided with a neck portion of relatively small cross sectional area defined between sloping guide surfaces 54 facing toward the entrance area 50 and a pair of opposed shoulders 56. Commencing adjacent the sloped surface 54, a pair of opposed guide slots 58 are provided and a stop surface 60 is disposed within each of the slots 58. When a terminal 26 is inserted into the cavity 48 as shown in FIGS. 15 and 16, the blade contact portion is guided into the slots 58 by the sloped surfaces 54. As the terminal is further inserted, the wing members 42 also enter the slots 58. The locking tang 44 is resiliently compressed toward the base 32 and moves through the reduced area neck portion of the cavity. When the tang clears the shoulders 56, the tang moves outwardly to engage one shoulder 56 and prevent inadvertent withdrawal of the terminal. Overinsertion is prevented by engagement of the leading edges of wing members 42 with the shoulders 60. The terminal may be inserted in either of two positions offset one hundred eighty degrees from each other and assembly of the connector is facilitated.

Upon insertion of a terminal 26 into a cavity 48, the base 32 of the terminal is captured and held in position between the shoulders 56 and 60. The blade contact portion 36 extends outwardly from the cavity 48 and is supported by the cavity structure in the nature of a projecting cantilever beam or spring.

With reference to the socket housing 24, this housing includes a front surface 62 onto which the cavities 48S directly open (FIGS. 10 and 16). Thus, in the case of the socket housing, the blade contacts 36 of the terminals 26S extend forwardly from the surface 62. With reference to the plug housing 22, the situation is somewhat different. As can be seen in FIGS. 7, 8 and 16, there is provided a contact chamber 64 at the forward end of each cavity 48P. The individual contact members 64 are separated from one another by means of a honeycomb-like, cored wall structure 66. As appears in FIG. 16, in profile each of the contact chambers 64 is somewhat in the shape of a modified parallelogram. The front surface of the plug housing 22 is defined by a forward wall 68 (FIGS. 5–8 and 16) onto which each of the contact chambers 64 opens.

In accordance with the invention there is provided structure for guiding the housings 22 and 24 relative to one another as they are joined together in face-to-face relationship. More specifically, the plug housing 24 is provided with a series of projections 70 extending to the sides of the housing from adjacent the front surface 62. The socket 24 is provided with a skirt wall 72 surrounding the periphery of the forward wall 62 of the socket. The skirt 72 serves to protect the blade contacts 36 extending from the wall 62 prior to joining of the housings 22 and 24 and also to receive the plug housing 22. In order to guide the housings relative to one another, the skirt wall 72 is provided with a group of inwardly opening slots or grooves 74 located to receive the guide projections 70 of the plug housing 22.

Initially as the housings 22 and 24 are moved toward one another, one of the projections 70 is received into each of the grooves 74. Preferably the projections 70 and grooves 74 are located at irregular positions at the edges of the housings in order to provide an indexing function by insuring that the housings can be joined only when in the proper orientation. Visual perception of the properly indexed position is facilitated by providing a relieved corner surface 76 on the plug housing 22 and a corresponding angled surface 78 on the skirt wall 72.

The path of relative movement between the housings 22 and 24 is fixed by the shape of the grooves 74. As can be seen with reference to FIGS. 3 and 4 each groove 74 is generally L-shaped. Thus as the housings are first moved together, the housings can only move in a first direction toward one another as the projections move along the upright leg of the "L". The two housings come fully into engagement with each other in an intermediate position wherein the forward wall 68 of the plug housing 22 is substantially in engagement with the front surface 62 of the socket housing 24. In this position, each guide projection 70 reaches the base portion of the corresponding L-shaped groove 74. It is now possible for the two housings 22 and 24 to be moved transversely relative to one another, with the projections 70 moving along the base of the "L".

In accordance with a feature of the present invention, there is provided a novel actuator member 80 for bringing about transverse movement of the housings 22 and 24 relative to one another. More specifically, and with reference now to FIGS. 1–4, the actuator element 80 is formed integrally with the socket housing 24 and is connected to a corner of the skirt wall 72 for pivotal movement by means of an integral hinge portion 82 of reduced cross sectional area. The actuator element 80 is movable from a released position illustrated in FIGS. 2 and 3 to a latched position illustrated in FIGS. 1 and 4. The actuator element is provided with an integral resilient latch arm 84 having a latch protuberance 86 defined at its end. As the actuator element 80 reaches its latched position, the protuberance 86 enters a latch recess 88 defined in the skirt wall 72, and the actuator element is held in latched position until the latch protuberance is released by lifting from the recess 88. An advantage of this arrangement is that in its latched position, the actuator 80 lies closely against the skirt wall 72 providing the assembly 20 with a smooth, compact shape.

The actuator element 80 is provided with a cam or actuating projection 90. As the actuator element 80 is moved to its latched position, the cam 90 enters an opening 92 in the skirt wall 72 and engages the end of the plug housing 22. Assuming that the plug housing 22 has been properly inserted into full engagement with the socket housing 24, the cam projection 90 forces the plug housing 22 in a transverse direction. The L-shaped configuration of the grooves 74 provide a bayonet-like locking action. As long as the actuator element 80 is latched, the two housings 22 and 24 cannot be separated by pulling them apart. Should the plug housing 22 not be fully seated within the socket housing 24, the actuator element 80 cannot be closed, and an indication is provided that the housings have not been properly assembled. It should also be noted that due to the integral hinging of the actuator element on the skirt wall 72, the element 80 acts as a lever and provides a mechanical advantage in effecting transverse movement of the housings 22 and 24 relative to one another.

As the housings 22 and 24 are moved to the intermediate position, the blade portion 36 of each socket housing terminal 26S is received within one of the contact chambers 64 adjacent to but spaced from one of the blade portions 36 of one plug housing terminal 26P. Since the terminals 26P and 26S do not contact one another at this time, zero insertion force is provided. Each contact set is then closed as the housings 22 and 24 are moved transversely of one another. The wall structure 66 surrounding each contact chamber serves to isolate each contact pair from its neighbors.

An important feature of the present invention resides in the novel contact arrangement provided by the action of the blade contact portions 36 of each set of terminals 26P and 26S as the housings 22 and 24 are moved transversely of one another. Having reference to FIG. 17, it can be seen that when the housings are initially joined, and prior to being moved transversely, the blade contacts 36 of each set of terminals are spaced from one another within the corresponding contact chamber 64. The blade contact portions of each pair include overlapping end segments which overlie one another. Importantly, the blade contact portions 36 are parallel with one another, and are inclined at an angle relative to the direction of transverse movement of the housings 22 and 24.

As noted above, in cross section, the chamber 64 is somewhat in the shape of a parallelogram, and for the most part the blade contact portions 36 are unsupported as they move into engagement with one another. However, there is provided a support shoulder 94 located behind the back surface of the blade contact 36 associated with the terminal 26P. This support shoulder 94 supports the blade contact 36 only adjacent one edge of the blade, the majority of the width of the blade being unsupported. The supported edge is that which is farthest from the other blade contact 36 of the socket housing terminal 26S.

As the two housings are moved transversely from their intermediate position of FIG. 17 toward the final position of FIG. 19, the two blade contact portions 36 move into engagement with one another as shown in FIG. 18. Relative to the contact chamber 64, the blade contact 36 of the terminal 26S moves toward the support shoulder 94 and toward the other blade contact 36. After engagement of the two contacts 36, some additional transverse housing movement takes place. During this additional movement, both terminals, in engagement with one another, twist or pivot around the support shoulder 94, and the support shoulder acts in the nature of a pivot. Due to this twisting or torsional movement and to the resiliency of the metal blade contacts 36, a highly desirable reliable electrical contact action takes place. Moreover, the need for exacting tolerances is avoided since this arrangement provides for a degree of overtravel.

In the illustrated embodiment of the invention, each of the several blade contacts 36 is disposed at a 45° angle relative to the direction of transverse housing movement. In light of the fact that the assembly 20 includes a large number of interconnections, it is desirable to normalize or cancel out those forces resulting from engagement of the contacts which are not in line with the direction of transverse housing movement thereby to avoid a tendency of the housings to bind against one another during transverse movement. For this reason, in the illustrated arrangement, two of the four rows of contacts are located offset 90° from the other two rows (FIGS. 5 and 9).

While the invention has been described with reference to details of the illustrated embodiment, such details are not intended to limit the scope of the invention as defined in the following claims.

What is claimed and desired to be secured by Letters Patent of the United States is:

1. A zero insertion force connector assembly including a pair of connector housings movable relative to one another in a first direction between a first position and a second position, a plurality of pairs of terminals, each pair including one terminal mounted on each housing, each terminal including one terminal mounted on each housing, each terminal including a contact structure projecting from its respective housing toward the other housing, the contact structures of each terminal pair being spaced from one another when said housings are in said first position and are adapted to move into electrical engagement when said housings are moved to said second position, the improvement in each pair of terminals comprising:

each contact structure being substantially identical and resilient, each contact structure including a generally planar front contact surface which is adapted to engage the front contact surface of the other contact structure, and two vertical edges; and each terminal pair including means disposing said contact structures such that when said front surfaces engage, the net force exerted near one edge of one contact structure is greater than the net force exerted near the other edge producing simultaneous torsion of both contact structures and producing a line of electrical contact between the front surfaces.

2. The assembly of claim 1 wherein each contact structure has a back surface, said means disposing said contact structures includes pivot support means for supporting the back surface of one contact structure of each pair adjacent one edge thereof providing a fulcrum about which said contact structures pivot when under torsion.

3. The assembly of claim 2 wherein each housing includes chambers formed therein, each chamber enclosing a terminal pair, said pivot support means being formed on said chamber.

4. The assembly of claim 1 wherein the contact surface of at least one terminal of each pair being disposed at an angle relative to movement in said first direction.

5. The assembly of claim 4, said contact structures of each terminal pair being substantially parallel to each other when the housings are in the first position.

6. The assembly of claim 5, said contact structures each being disposed at about forty-five degrees to said second direction.

7. The assembly of claim 6, the contact structures of about half the pairs of terminals being disposed at about ninety degrees to the other half.

8. The assembly of claim 1, each terminal including a conductor engaging portion, and a base portion between said contact structure and said conductor engaging portion.

9. The assembly of claim 8 wherein each housing includes an array of cavities for receiving said terminals, the base portion of each terminal including locking means for capturing said terminals upon insertion into said cavities.

10. A zero insertion force connector assembly comprising:

a connector receptacle housing;

a connector plug housing adapted to be received in said receptacle housing;

bayonet guide means formed between receptacle and plug housings to allow movement of said plug housing relative to the receptacle housing in a first direction toward the receptacle housing from an initial position to a fully inserted intermediate position within the receptacle housing and then in a second direction generally perpendicular to the first direction from an intermediate position to a final position;

a plurality of pairs of terminals, each pair including one terminal mounted in the plug housing and the other terminal mounted in the receptacle housing, each terminal including a substantially identical resilient contact structure projecting from its respective housing toward the other housing, the contact structures of each terminal pair being spaced from one another when said plug housing is in the intermediate position and are adapted to move into electrical engagement when the plug housing is moved to the final position, each contact structure having a generally planar front contact surface which is adapted to engage the front contact surface of the other contact structure and two vertical edges, the contact surface of at least one terminal of each pair being disposed at an angle relative to movement in said second direction, each terminal pair including means disposing said contact structures such that when said front surfaces engage, the net force exerted near one edge of the contact structure is greater than the net force exerted near the other edge producing simultaneous torsion of both contact structures and producing a line of electrical contact between the front surfaces;

an actuator member integrally formed on said receptacle housing movable between an unlocked position and a locked position, said actuator member including a cam surface adapted to engage said plug housing when said actuator member is moved to its locked position which moves said plug housing in the second direction from the intermediate position to the final position, and latch means engageable with the receptacle housing when said actuator is moved to its locked position for positively locking said plug housing in the final position.

11. The assembly of claim 10, an integral hinge interconnecting said actuator means and said one housing.

12. The assembly of claim 10 wherein said bayonet guiding means includes projection means on the plug housing and slot means on the receptacle housing.

13. The assembly of claim 12 wherein, said slot means being L-shaped.

* * * * *